US009646525B2

(12) United States Patent
Kim et al.

(10) Patent No.: US 9,646,525 B2
(45) Date of Patent: May 9, 2017

(54) DISPLAY DEVICE AND MULTI-PANEL DISPLAY DEVICE

(71) Applicant: Samsung Display Co., Ltd., Yongin, Gyeonggi-Do (KR)

(72) Inventors: Ilgon Kim, Seoul (KR); Bonghyun You, Yongin-si (KR); Sangjin Jeon, Suwon-si (KR); Meehye Jung, Suwon-si (KR); Junki Jeong, Anyang-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 233 days.

(21) Appl. No.: 14/322,717

(22) Filed: Jul. 2, 2014

(65) Prior Publication Data

US 2015/0161928 A1 Jun. 11, 2015

(30) Foreign Application Priority Data

Dec. 6, 2013 (KR) ..... 10-2013-0151698

(51) Int. Cl.

| | |
|---|---|
| ***G09G 3/20*** | (2006.01) |
| ***G09G 3/3225*** | (2016.01) |
| ***G09G 3/36*** | (2006.01) |

(52) U.S. Cl.

CPC ..... *G09G 3/20* (2013.01); *G09G 3/3225* (2013.01); *G09G 3/3666* (2013.01); *G09G 2300/026* (2013.01); *G09G 2310/0221* (2013.01); *G09G 2310/0281* (2013.01); *G09G 2330/08* (2013.01); *G09G 2360/04* (2013.01)

(58) Field of Classification Search

CPC ..... G09G 3/3648; G09G 3/3614; G09G 2300/0426; G09G 3/3677

USPC ..... 345/55; 349/139

See application file for complete search history.

(56) References Cited

U.S. PATENT DOCUMENTS 7,133,013 B2 * 11/2006 Kamezaki ..... G09G 3/3677 345/100
7,239,742 B2 * 7/2007 Ohtani ..... G06F 1/3228 382/162

(Continued)

FOREIGN PATENT DOCUMENTS

JP 2003-329996 A 11/2003
JP 2006-251534 A 9/2006

(Continued)

*Primary Examiner* — David Vu
*Assistant Examiner* — Jonathan Han
(74) *Attorney, Agent, or Firm* — Knobbe Martens Olson & Bear LLP

(57) ABSTRACT

A display device and a multi-panel display device are disclosed. In one aspect, the display panel includes a plurality of display areas, an intermediate non-display area, a first non-display area, and a second non-display area. The display areas are spaced apart from one another in the first direction or the second direction. The intermediate non-display area is formed between the display areas. The first non-display area is formed at the outermost position in the first direction. The second non-display area is formed at the outermost position in the second direction. The gate driver is formed in the first non-display area, the second non-display area, and the intermediate non-display area and is configured to supply a gate signal to gate lines formed in each display area.

13 Claims, 4 Drawing Sheets

(56) References Cited

U.S. PATENT DOCUMENTS

| | | | | |
|---|---|---|---|---|
| 7,327,341 | B2 * | 2/2008 | Toriumi | G09G 3/3648 345/212 |
| 7,755,565 | B2 | 7/2010 | Park et al. | |
| 8,471,981 | B2 * | 6/2013 | Kim | G02F 1/13336 349/151 |
| 2010/0328192 | A1 | 12/2010 | Hara et al. | |

FOREIGN PATENT DOCUMENTS

| | | | |
|---|---|---|---|
| JP | 2008-090329 | A | 4/2008 |
| JP | 2012-132960 | A | 7/2012 |
| KR | 10-0202235 | B1 | 3/1999 |
| KR | 10-2006-0083715 | A | 7/2006 |
| KR | 10-2006-0116104 | A | 11/2006 |
| KR | 10-0950228 | B1 | 3/2010 |
| KR | 10-2015-0047400 | A | 5/2015 |
| KR | 10-2016-0002511 | A | 1/2016 |

* cited by examiner

DISPLAY DEVICE AND MULTI-PANEL DISPLAY DEVICE

CROSS-REFERENCE TO RELATED APPLICATIONS

This U.S. non-provisional patent application claims priority under 35 U.S.C. §119 of Korean Patent Application No. 10-2013-0151698, filed on Dec. 6, 2013, the contents of which are hereby incorporated by reference in its entirety.

BACKGROUND

Field

The described technology generally relates to a display device and a multi-panel display device.

Description of the Related Technology

A display device includes a display panel and a driver that drives the display panel. The display panel includes a display area that can show an image and a non-display area surrounding the display area. The display area includes gate lines extending in a first direction and data lines extending in a second direction substantially perpendicular to the first direction.

The driver includes a timing controller, a gate driver, and a data driver. The gate driver is formed in a non-display area, which is formed outside of the display area in the first direction, and electrically connected to the gate lines. The data driver is mounted on a chip-on-film (COF) package or a printed circuit board (PCB). The COF package or the PCB is electrically connected to the non-display area formed outside of the display area in the second direction.

SUMMARY OF CERTAIN INVENTIVE ASPECTS

One inventive aspect is a display device having a reduced bezel size and a multi-panel display device.

Another aspect is a display device including a display panel and a gate driver.

The display panel includes display panels, an intermediate non-display area, a first non-display area, and a second non-display area. The display areas are spaced apart from each other in a first direction or a second direction opposite to the first direction. The intermediate non-display area is formed between the display areas in the first direction or the second direction. The first non-display area is formed at an outermost position in the first direction, and the second non-display area is formed at an outermost position in the second direction.

The gate driver is formed in each of the first non-display area, the second non-display area, and the intermediate non-display area to apply a gate signal to gate lines formed in each of the display areas.

A number of the display areas is "i" that is a positive integer number equal to or greater than 2, and a number of the gate drivers is equal to or greater than "i" and equal to or less than "2i".

The display areas include a first display area and a second display area, which are sequentially arranged in the second direction.

The gate driver includes a first gate driver and a second gate driver. The first gate driver is connected to first gate lines formed in the first display area to apply a first gate signal to the first gate lines. The second gate driver is connected to second gate lines formed in the second display area to apply a second gate signal to the second gate lines.

The first gate driver includes a first sub-gate driver and a second sub-gate driver. The first sub-gate driver is formed in the first non-display area and connected to one end of the first gate lines. The second sub-gate driver is formed in the intermediate non-display area and connected to the other end of the first gate lines.

The second gate driver includes a third sub-gate driver and a fourth sub-gate driver. The third sub-gate driver is formed in the intermediate non-display area and connected to one end of the second gate lines and the fourth sub-gate driver is formed in the second non-display area and connected to the other end of the second gate lines.

The intermediate non-display area has a width equal to or smaller than a sum of a width of the first non-display area and a width of the second non-display area.

Another aspect is a display device including a display panel, a printed circuit board, a gate flexible printed circuit board, and a connection line.

The display panel includes display areas, an intermediate non-display area, a first non-display area, and a second non-display area. The display areas are spaced apart from each other in a first direction or a second direction opposite to the first direction. The intermediate non-display area is formed between the display areas in the first direction or the second direction. The first non-display area is formed at an outermost position in the first direction, and the second non-display area is formed at an outermost position in the second direction.

The printed circuit board drives the display panel. The gate flexible printed circuit board electrically connects the display panel and the printed circuit board and includes a gate driver mounted thereon to apply a gate signal to gate lines formed in each of the display area.

The connection line is formed in the first non-display area, the second non-display area, and the intermediate non-display area to connect the gate flexible printed circuit board and the gate lines.

Another aspect is a multi-panel display device including a plurality of display panels, a printed circuit board, and a flexible printed circuit board. The display panels are formed to be adjacent to each other in a first direction or a second direction opposite to the first direction. The printed circuit board drives the display panels. The flexible printed circuit board electrically connects the display panels and the printed circuit board.

Another aspect is a display device including a display panel and a gate driver. The display panel includes: a plurality of display areas spaced apart from one another in a first direction or a second direction opposite to the first direction, an intermediate non-display area formed between the display areas, a first non-display area formed at the outermost position in the first direction, and a second non-display area formed at the outermost position in the second direction. The gate driver is formed in each of the first non-display area, the second non-display area, and the intermediate non-display area, wherein the gate driver is configured to supply a gate signal to gate lines formed in each display area.

In the above display device, the number of display areas is greater than or equal to 2, and the number of gate drivers is greater than or equal to the number of display areas and equal to or less than twice the number of display areas. In the above display device, the display areas include first and second display areas sequentially arranged in the second direction. In the above display device, the gate driver includes: a first gate driver electrically connected to a plurality of first gate lines formed in the first display area, wherein the first gate driver is configured to supply a first gate signal to the first gate lines, and a second gate driver electrically connected to a plurality of second gate lines formed in the second display area, wherein the second gate driver is configured to supply a second gate signal to the second gate lines.

In the above display device, the first gate driver includes: a first sub-gate driver formed in the first non-display area and electrically connected to a first end of the first gate lines, and a second sub-gate driver formed in the intermediate non-display area and electrically connected to a second end of the first gate lines. In the above display device, the second gate driver includes: a third sub-gate driver formed in the intermediate non-display area and electrically connected to a first end of the second gate lines, and a fourth sub-gate driver formed in the second non-display area and electrically connected to a second end of the second gate lines.

In the above display device, the first and second sub-gate drivers supply a first gate signal to each of the first gate lines, and the third and fourth sub-gate drivers supply a second gate signal to each of the first gate lines. In the above display device, the first sub-gate driver supplies the first gate signal to the first gate lines, the second sub-gate driver supplies the first gate signal to the first gate lines, the third sub-gate driver supplies the second gate signal to the second gate lines, and the fourth sub-gate driver supplies the second gate signal to the second gate lines.

In the above display device, the intermediate non-display area has a width substantially equal to or less than the sum of the width of the first non-display area and the width of the second non-display area. The above display device further includes: a printed circuit board that is configured to drive the display panel, and a flexible printed circuit board electrically connecting the display panel to the printed circuit board.

Another aspect is a display device, including a display panel, a printed circuit board, a gate flexible printed circuit board, and a connection line. The display panel includes: a plurality of display areas spaced apart from one another in a first direction or a second direction opposite to the first direction, an intermediate non-display area formed between the display areas, a first non-display area formed at the outermost position in the first direction, and a second non-display area formed at the outermost position in the second direction. The printed circuit board is configured to drive the display panel. The gate flexible printed circuit board electrically connects the display panel to the printed circuit board, wherein the gate flexible printed circuit board includes a gate driver mounted thereon, and wherein the gate driver is configured to supply a gate signal to gate lines formed in each of the display areas. The connection line is formed in the first non-display area, the second non-display area, and the intermediate non-display area, wherein the connection line electrically connects the gate flexible printed circuit board to the gate lines.

In the above display device, the display areas include a first display area and a second display area, wherein the first display area and the second display area are sequentially arranged in the second direction. In the above display device, the gate driver includes: a first gate driver electrically connected to a plurality of first gate lines formed in the first display area, wherein the first gate driver is configured to supply a first gate signal to the first gate lines, and a second gate driver electrically connected to a plurality of second gate lines formed in the second display area, wherein the second gate driver is configured to supply a second gate signal to the second gate lines.

In the above display device, the connection line includes: a first connection line formed in the first non-display area and electrically connected to a first end of the first gate lines, a second connection line formed in the intermediate non-display area and electrically connected to the second end of the first gate lines, a third connection line formed in the intermediate non-display area and electrically connected to a first end of the second gate lines, and a fourth connection line formed in the second non-display area and electrically connected to the second end of the second gate lines. In the above display device, the intermediate non-display area has a width substantially equal to or less than the sum of the width of the first non-display area and the width of the second non-display area.

Another aspect is a multi-panel display device, including: a plurality of display panels adjacent to one another in a first direction and a second direction opposite to the first direction, a printed circuit board configured to drive the display panels, and a flexible printed circuit board electrically connecting the display panels to the printed circuit board. Each of the display panels includes: a plurality of display areas spaced apart from one another in the first direction or the second direction, an intermediate non-display area formed between the display areas, a first non-display area formed at the outermost position in the first direction, a second non-display area formed at the outermost position in the second direction, and a gate driver formed in each of the first non-display area, the second non-display area, and the intermediate non-display area, wherein the gate driver is configured to supply a gate signal to gate lines formed in each of the display areas.

In the above multi-panel display device, the number of display areas is greater than or equal to 2, and the number of gate drivers is greater than or equal to the number of display areas equal to or is less than twice the number of display areas. In the above multi-panel display device, the display areas include first and second display areas sequentially arranged in the second direction. In the above multi-panel display device, the gate driver includes: a first gate driver electrically connected to a plurality of first gate lines formed in the first display area, wherein the first gate driver is configured to supply a first gate signal to the first gate lines, and a second gate driver electrically connected to a plurality of second gate lines formed in the second display area, wherein the second gate driver is configured to supply a second gate signal to the second gate lines.

In the above multi-panel display device, the first gate driver includes: a first sub-gate driver formed in the first non-display area and electrically connected to a first end of the first gate lines, and a second sub-gate driver formed in the intermediate non-display area and electrically connected to a second end of the first gate lines. In the above multi-panel display device, the second gate driver includes: a third sub-gate driver formed in the intermediate non-display area and electrically connected to a first end of the second gate lines, and a fourth sub-gate driver formed in the second non-display area and electrically connected to a second end of the second gate lines.

In the above multi-panel display device, the intermediate non-display area has a width substantially equal to or less than the sum of the width of the first non-display area and the width of the second non-display area.

Another aspect is a display device, including: a plurality of display panels adjacent to one another in a first direction and a second direction opposite to the first direction, a printed circuit board that is configured to drive the display panels, and a gate flexible printed circuit board electrically connecting the display panels to the printed circuit board, wherein the gate flexible printed circuit board includes a gate driver mounted thereon, and wherein the gate driver is configured to supply a gate signal to gate lines formed in each of the display areas. Each of the display panels includes: a plurality of display areas spaced apart from one another in the first direction or the second direction, an intermediate non-display area formed between the display areas, a first non-display area formed at the outermost position in the first direction, a second non-display area formed at the outermost position in the second direction, and a connection line formed in the first non-display area, the second non-display area, and the intermediate non-display area, wherein the connection line electrically connects the gate flexible printed circuit board to the gate lines.

Another aspect is a display device, including: a display panel and a gate driver. The display panel includes: a plurality of display areas spaced apart from one another in a first direction or a second direction opposite to the first direction, and a plurality of non-display areas, wherein at least one non-display area is formed between the display areas, and wherein at least one non-display area is formed in the outermost position in each of the first and second directions. The gate driver is formed in each non-display area, wherein the gate driver is configured to supply a gate signal to gate lines formed in each of the display areas.

In the above display device, the number of display areas is greater than or equal to 2, and the number of gate drivers is greater than or equal to the number of display areas and equal to or less than twice the number of display areas.

In the above display device, the display areas include first and second display areas sequentially arranged in the second direction. In the above display device, the gate driver includes: a first gate driver electrically connected to a plurality of first gate lines formed in the first display area, wherein the first gate driver is configured to supply a first gate signal to the first gate lines, and a second gate driver electrically connected to a plurality of second gate lines formed in the second display area, wherein the second gate driver is configured to supply a second gate signal to the second gate lines.

According to at least one embodiment, the width of the non-display area formed at the outermost position of the display device can be reduced by adjusting the position on which the gate driver is mounted. As a result, the non-display area formed between the display areas of the multi-panel display device can be reduced to approximately half the size, which is not recognized by the viewer.

DETAILED DESCRIPTION OF CERTAIN INVENTIVE EMBODIMENTS

Figure 1:
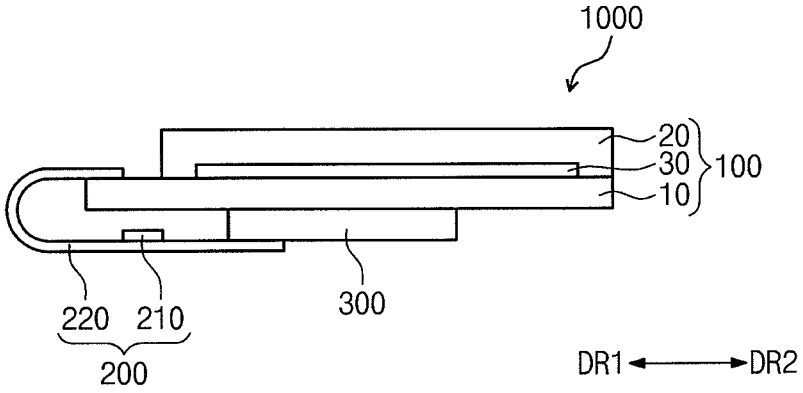
FIG. 1 is a cross-sectional view showing a display device 1000 according to an exemplary embodiment.

It will be understood that when an element or layer is referred to as being "on", "connected to" or "coupled to" another element or layer, it can be directly on, connected or coupled to the other element or layer or intervening elements or layers can be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the described technology.

Spatially relative terms, such as "beneath", "below", "lower", "above", "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device can be otherwise oriented (rotated 90 degrees or at other orientations) and the spatially relative descriptors used herein interpreted accordingly.

The terminology used herein is for the purpose of describing particular embodiments only and is not intended to be limiting of the described technology. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the described technology will be explained in detail with reference to the accompanying drawings.

Figure 2:
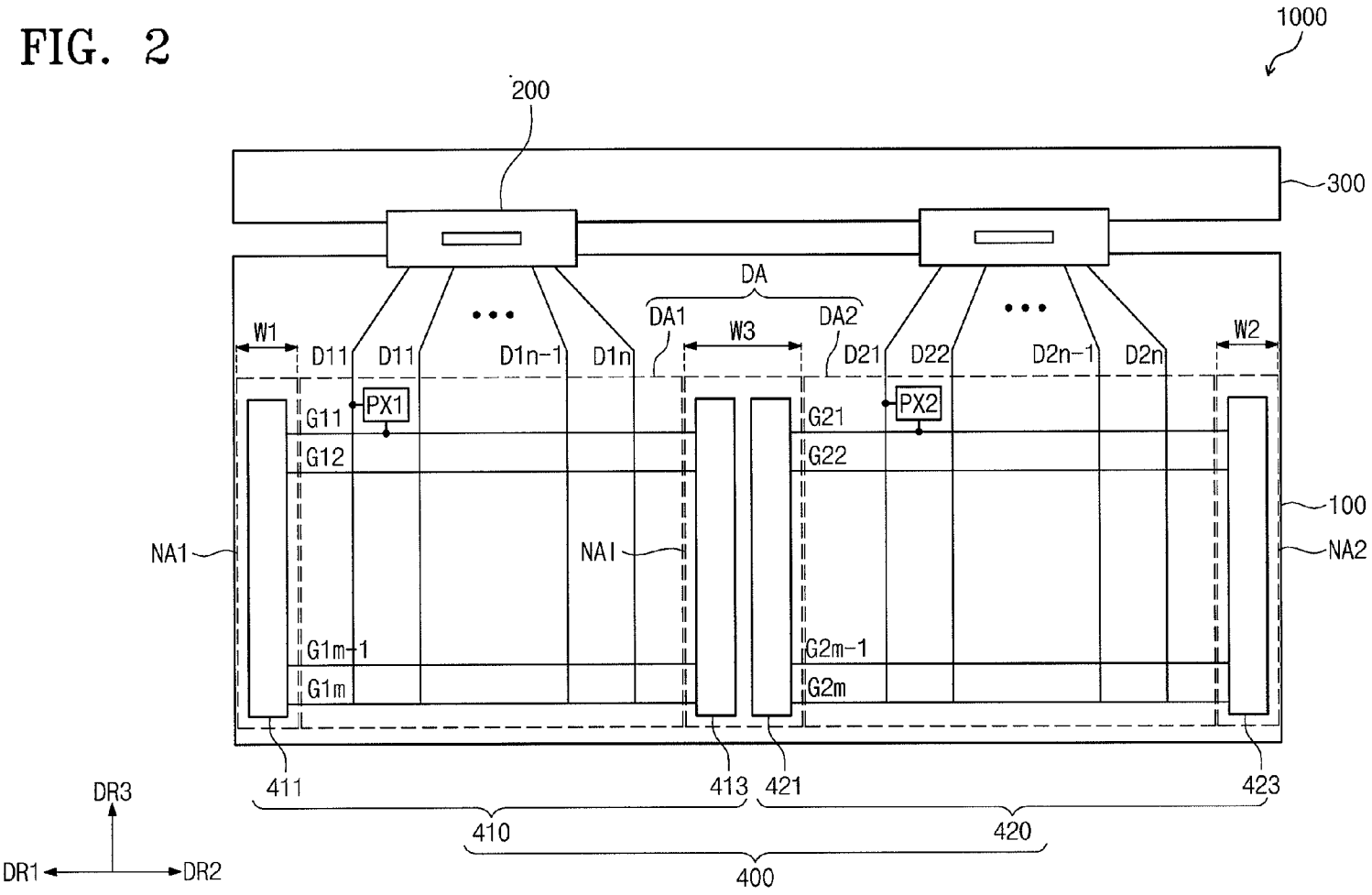
FIG. 2 is a plan view showing the display device 1000 shown in FIG. 1.

FIG. 1 is a cross-sectional view showing the display device 1000 according to an exemplary embodiment. FIG. 2 is a plan view showing the display device 1000 shown in FIG. 1.

Referring to FIGS. 1 and 2, the display device 1000 includes a display panel 100, a flexible printed circuit board (PCB) 200, and a printed circuit board 300.

The display panel 100 can display an image. The display panel 100 can be an organic light-emitting diode (OLED) display panel, a liquid crystal display (LCD) panel, a plasma display panel, an electrophoretic display panel, or an electrowetting display panel. In the present exemplary embodiment, the OLED display panel will be described as the display panel 100.

The display panel 100 includes a thin film transistor (TFT) substrate 10, a sealing layer 20, and a light-emitting layer 30 formed between the thin film transistor substrate 10 and the sealing layer 20.

The display panel 100 is rectangular. Hereinafter, a first direction DR1 indicates one direction of a long side of the display panel 100, a second direction DR2 indicates a direction substantially opposite to the one direction of the long side of the display panel 100, and a third direction DR3 indicates a direction substantially perpendicular to the first and second directions DR1 and DR2. However, the first, second, and third directions DR1, DR2, and DR3 should not be limited thereto or thereby. That is, the first direction DR1 can indicate one direction of a short side of the display panel 100, the second direction DR2 can indicate a direction substantially opposite to the first direction DR1, and the third direction DR3 can indicate a direction substantially perpendicular to the first and second directions DR1 and DR2.

The thin film transistor substrate 10 includes display areas DA and a non-display area surrounding the display areas DA. The display areas DA are areas in which a viewer recognizes the image, and the non-display area is an area in which the viewer does not recognize the image because the non-display area is shielded by a black matrix.

The display areas DA are spaced apart from one another in the first and second directions DR1 and DR2. In the present exemplary embodiment, the number of the display areas DA is "i", which is a positive integer number equal to or greater than two. The display areas DA include a first display area DA1 and a second display area DA2.

The non-display area includes a first non-display area NA1, a second non-display area NA2, and an intermediate non-display area NAI.

The first non-display area NA1 is formed at the outermost position in the first direction DR1. The second non-display area NA2 is formed at the outermost position in the second direction DR2. The intermediate non-display area NAI is formed between the first display area DA1 and the second display area DA2.

The first display area DA1 includes a plurality of first gate lines G11 to G1*m*, a plurality of first data lines D11 to D1*n*, and a plurality of first pixels PX1. The first pixels PX1 are arranged in areas defined by the first gate lines G11 to G1*m* and the first data lines D11 to D1*n* in a matrix form. The first gate lines G11 to G1*n* extend in the first and second directions DR1 and DR2 and are spaced apart from one another in the third direction DR3. The first data lines D11 to D1*n* are substantially insulated from the first gate lines G11 to G1*m*. The first data lines D11 to D1*n* extend in the third direction DR3 and are spaced apart from one another in the first and second direction DR1 and DR2.

The second display area DA2 includes a plurality of second gate lines G21 to G2*m*, a plurality of second data lines D21 to D2*n*, and a plurality of second pixels PX2. The second pixels PX2 are arranged in areas defined by the second gate lines G21 to G2*m* and the second data lines D21 to D2*n* in a matrix form. The second gate lines G21 to G2*n* extend in the first and second directions DR1 and DR2 and are spaced apart from one another in the third direction DR3. The second data lines D21 to D2*n* are substantially insulated from the second gate lines G21 to G2*m*. The second data lines D21 to D2*n* extend in the third direction DR3 and are spaced apart from one another in the first and second direction DR1 and DR2.

The sealing layer 20 is formed to face the thin film transistor substrate 10. The light-emitting layer 30 is formed between the sealing layer 20 and the thin film transistor substrate 10. The sealing layer 20 substantially seals the light-emitting layer 30. The sealing layer 20 includes a plurality of layers and the black matrix, which is formed between the layers. The black matrix substantially overlaps the first non-display area NA1, the second non-display area NA2, and the intermediate non-display area NAI when viewed in a plan view.

The light-emitting layer 30 includes a first electrode, an organic light-emitting layer formed on the first electrode, and a second electrode formed on the organic light-emitting layer. In some embodiments, the first electrode corresponds to an anode as a hole injection electrode and the second electrode corresponds to a cathode as an electron injection electrode, but they should not be limited thereto or thereby. Depending on a driving method of the display device, the first electrode can serve as the cathode and the second electrode can serve as the anode. A hole and an electron are injected into the light-emitting layer 30 through the first and second electrodes respectively, and are recombined in the light-emitting layer to generate excitons. The excitons emit energy discharged when an excited state returns to a ground state as light. The first electrode is formed at least partially of a light transmission material and the second electrode is formed at least partially of a light reflection material. Accordingly, light is emitted from the light-emitting layer 30 to the thin film transistor substrate 10.

The flexible printed circuit board 200 electrically connects the display panel 100 to the printed circuit board 300. The flexible printed circuit board 200 includes a base film 220 and an integrated circuit chip 210 formed on the base film 220.

FIG. 2 shows two flexible printed circuit boards 200 spaced apart from each other in the first and second directions DR1 and DR2, but the number of the flexible printed circuit boards 200 should not be limited to two.

A portion of the flexible PCB 200 is attached to the PCB 300. The flexible PCB 200 extends in the first direction DR1. The flexible PCB 200 bends to create a "C" shape such that one side is attached to an upper surface of the TFT substrate 10.

The printed circuit board 300 drives the display panel 100. The flexible printed circuit board 200 includes a driving substrate (not shown) and a plurality of circuit components (not shown) mounted on the driving substrate (not shown). The printed circuit board 300 is attached to a lower surface of the thin film transistor substrate 10 while the flexible printed circuit board 200 is bent.

The display device 1000 further includes a timing controller (not shown), a data driver (not shown), and a gate driver 400.

The timing controller is mounted on the flexible printed circuit board 200 or the printed circuit board 300. The timing controller receives a control signal and generates a gate control signal and a data control signal. The timing controller supplies the gate control signal to the gate driver 400 and the data control signal to the data driver. The timing controller receives an image signal and supplies the image signal to the data driver.

The gate control signal includes a vertical start signal to start an operation of the gate driver 400 and a gate clock signal to determine an output timing of the gate signal.

The data control signal includes a horizontal start signal to start an operation of the data driver, a polarity inversion signal to control a polarity of the data voltage output from the data driver, and a load signal to determine an output timing of the data voltage.

The data driver is mounted on the flexible printed circuit board 200. The data driver supplies the image signal to the data lines D11 to D1*n* and D21 to D2*n* in response to the data control signal. The data driver includes a first data driver to supply the image signal to the first data lines D11 to D1*n* and a second data driver to supply the image signal to the second data lines D21 to D2*n*.

The gate driver 400 is mounted on the thin filth transistor substrate 10. In detail, the gate driver 400 is formed to overlap the first non-display area NA1, the second non-display area NA2, and the intermediate non-display area NAI.

The number of the gate drivers 400 is equal to or greater than "i" and equal to or less than "2i". In the present exemplary embodiment, the number of the display areas DA is two, and the number of the gate drivers 400 is two or four.

The gate driver 400 includes a first gate driver 410 and a second gate driver 420.

The first gate driver 410 is formed in a portion of the first non-display area NA1 and a portion of the intermediate non-display area NAI, and is electrically connected to the first gate lines G11 to G1*m*.

The first gate driver 410 generates a first gate signal based at least in part on the gate control signal. The first gate driver 410 sequentially supplies the first gate signal to the first gate lines G11 to G1*m*.

The first gate driver 410 includes a first sub-gate driver 411 and a second sub-gate driver 413. The first sub-gate driver 411 is formed in the first non-display area NA1 and the second sub-gate driver 413 is formed in the intermediate non-display area NAI.

In the present exemplary embodiment, the first sub-gate driver 411 and the second sub-gate driver 413 can serve as one gate driver. For example, the first sub-gate driver 411 and the second sub-gate driver 413 supply one first gate signal to each of the first gate lines G11 to G1*m* in each frame. The number of components required for one gate driver can be shared by the first and second sub-gate drivers 411 and 413. For example, the first sub-gate driver 411 determines a pulse start point of the gate signal and the second sub-gate driver 413 determines a pulse end point of the gate signal.

The first sub-gate driver 411 and the second sub-gate driver 413 can be individually operated. The first sub-gate driver 411 can supply the first gate signal to the first gate lines G11 to G1*m* and the second sub-gate driver 413 can supply the first gate signal to the first gate lines G11 to G1*m*. When the first and second sub-gate drivers 411 and 413 are individually operated as the one gate driver, a delay of the signal supplied to each of the first gate lines G11 to G1*m* is reduced by approximately a half compared to that when the first and second sub-gate drivers 411 and 413 are operated as the one gate driver.

The second gate driver 420 is formed in a portion of the second non-display area NA2 and a portion of the intermediate non-display NAI, and is electrically connected to the second gate lines G21 to G2*m*.

The second gate driver 420 includes a third sub-gate driver 421 and a fourth sub-gate driver 423. The third sub-gate driver 421 is formed in the intermediate non-display area NAI and the fourth sub-gate driver 423 is formed in the second non-display area NA2. The third sub-gate driver 421 and the fourth sub-gate driver 423 are spaced apart from each other in the first and second directions DR1 and DR2.

In the present exemplary embodiment, the third and fourth sub-gate drivers 421 and 423 can be operated as one gate driver. In addition, the third and fourth sub-gate drivers 421 and 423 can be individually operated as the one gate driver. Because the third and fourth sub-gate drivers 421 and 423 correspond to the first and second sub-gate drivers 411 and 413, respectively, details thereof will be omitted.

The width W3 of the intermediate non-display area NAI is substantially equal to or less than a sum of the width W1 of the first non-display area NA1 and the width W2 of the second non-display area NA2.

As described above, because the first sub-gate driver 411 is formed in the first non-display area NA1 and the fourth sub-gate driver 423 is formed in the second non-display area NA2, the width W1 and the width W2 can be less than that when the first and second gate drivers 410 and 420 are respectively formed in the first and second non-display areas NA1 and NA2. In some embodiments, when the first non-display area NA1 and the second non-display area NA2 are not recognizable by the viewer, the intermediate non-display area NAI is also not recognizable by the viewer.

Figure 3:
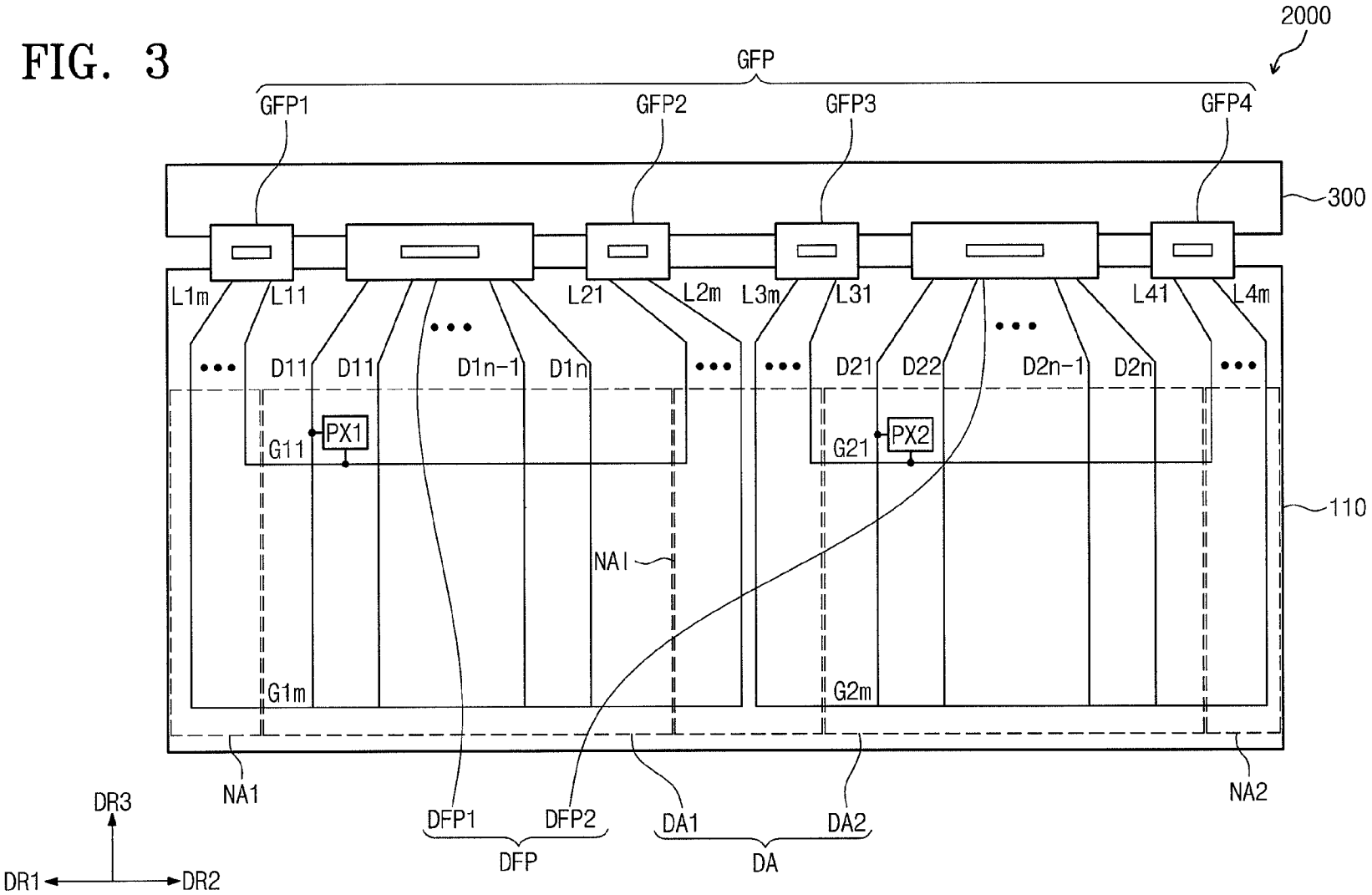
FIG. 3 is a plan view showing a display device 2000 according to an exemplary embodiment.

FIG. 3 is plan view showing the display device 2000 according to an exemplary embodiment. In FIG. 3, the same reference numerals denote the same elements in FIGS. 1 and 2, and thus, detailed descriptions of the same elements will be omitted.

Referring to FIG. 3, the display device 2000 includes a display panel 110, a gate flexible printed circuit board GFP, a data flexible printed circuit board DFP, and a printed circuit board 300.

The gate flexible printed circuit board GFP electrically connects the display panel 110 to the printed circuit board 300. In FIG. 3, the gate flexible printed circuit board GFP includes first to fourth gate flexible printed circuit boards GFP1 to GFP4, but the number of the gate flexible printed circuit boards GFP should not be limited to four.

The data flexible printed circuit board DFP electrically connects the display panel 110 to the printed circuit board 300. In FIG. 3, the data flexible printed circuit board DFP includes first and second data flexible printed circuit boards DFP1 and DFP2, but the number of the data flexible printed circuit boards should not be limited to two.

Each of the gate flexible printed circuit board GFP and the data flexible printed circuit board DFP has a "C" shape when attached to the display panel 100. Each of the gate flexible printed circuit board GFP and the data flexible printed circuit board DFP can have flexibility.

The display device 2000 further includes a timing controller (not shown), a data driver (not shown), and a gate driver (not shown).

The data driver can be mounted on the data flexible printed circuit board DFP. The data driver includes a first data driver electrically connected to the first data lines D11 to D1*m* and a second data driver electrically connected to the second data lines D21 to D2*m*. The first data driver is mounted on a first data flexible printed circuit board DFP1, and the second data driver is mounted on a second data flexible printed circuit board DFP2.

The gate driver is mounted on the gate flexible printed circuit board GFP. The gate driver includes a first gate driver electrically connected to the first gate lines G11 to G1*n* and a second gate driver electrically connected to the second gate lines G21 to G2*n*.

The first gate driver includes a first sub-gate driver and a second sub-gate driver. The first sub-gate driver is mounted on a first gate flexible printed circuit board GFP1, and the second sub-gate driver is mounted on a second gate flexible printed circuit board GFP2.

The second gate driver includes a third sub-gate driver and a fourth sub-gate driver. The third sub-gate driver is mounted on a third gate flexible printed circuit board GFP3, and the fourth sub-gate driver is mounted on a fourth gate flexible printed circuit board GFP4.

The display panel 110 includes connection lines to electrically connect the gate flexible printed circuit board GFP to the gate lines G11 to G1*m* and G21 to G2*m*.

The connection lines includes first connection lines L11 to L1*m*, second connection lines L21 to L2*m*, third connection lines L31 to L3*m*, and fourth connection lines L41 to L4*m*.

The first connection lines L11 to L1*m* are electrically connected between the first gate flexible printed circuit board GFP1 and first ends of the first gate lines G11 to G1*m*. The second connection lines L21 to L2*m* are electrically connected between the second gate flexible printed circuit board GFP2 and second ends of the first gate lines G11 to G1*m*. The third connection lines L31 to L3*m* are electrically connected between the third gate flexible printed circuit board GFP3 and first ends of the second gate lines G21 to G2*m*. The fourth connection lines L41 to L4*m* are electrically connected between the fourth gate flexible printed circuit board GFP4 and second ends of the second gate lines G21 to G2*m*.

Each of the first and second sub-gate drivers is electrically connected to the first gate lines G11 to G1*m* through the first and second connection lines L11 to L1*m* and L21 to L2*m*. Each of the third and fourth sub-gate drivers is electrically connected to the second gate lines G21 to G2*m* through the third and fourth connection lines L31 to L3*m* and L41 to L4*m*.

The connection lines are formed to overlap the first non-display area NA1, the second non-display area NA2, and the intermediate non-display area NAI. For example, the first connection lines L11 to L1*m* are formed in the first non-display area NA1, the second connection lines L21 to L2*m* and the third connection lines L31 to L3*m* are formed in the intermediate non-display area NAI, and the fourth connection lines L41 to L4*m* are formed in the second non-display area NA2.

Figure 4:
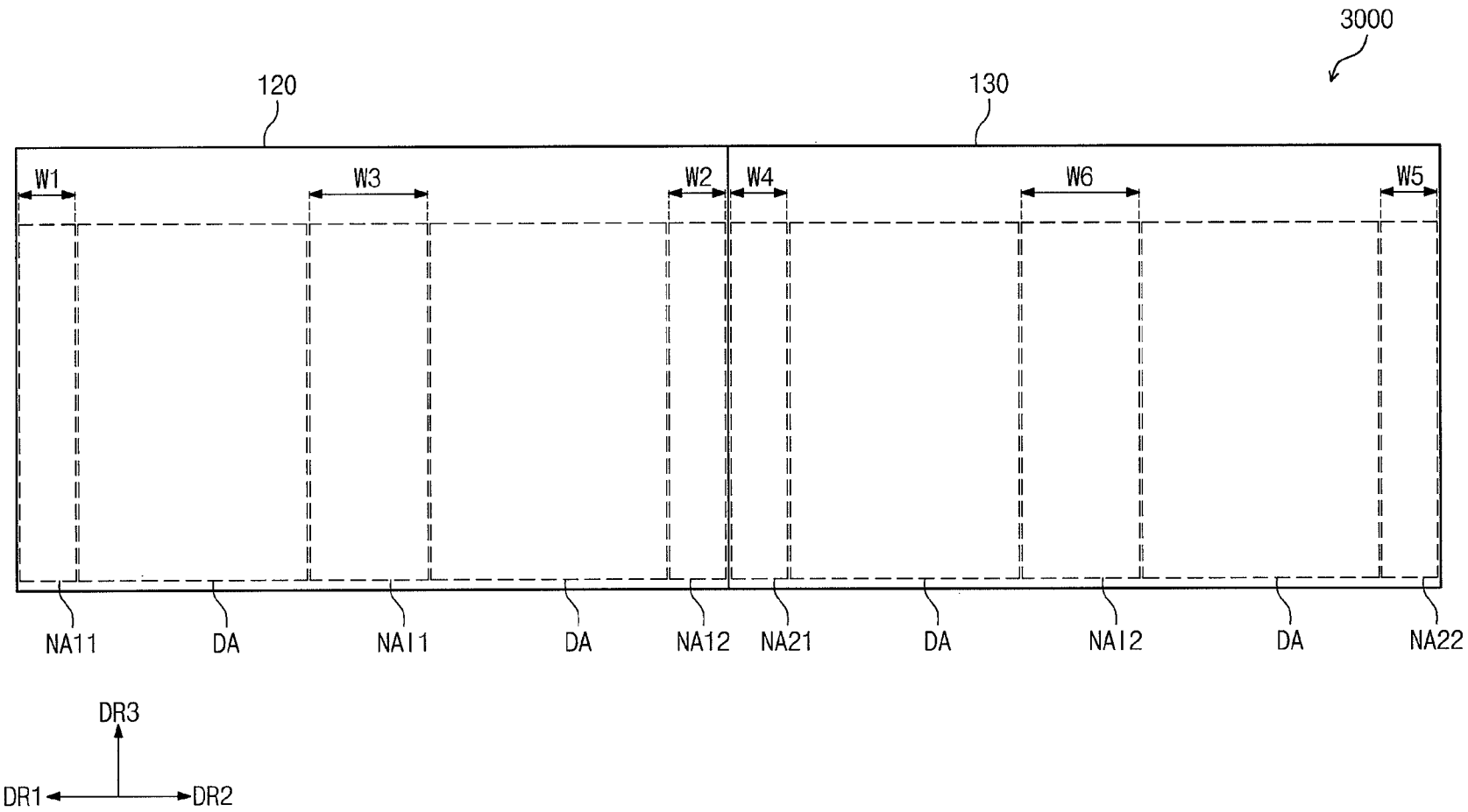
FIG. 4 is a plan view showing a multi-panel display device 3000 according to an exemplary embodiment.

FIG. 4 is a plan view showing the multi-panel display device 3000 according to an exemplary embodiment.

Referring to FIG. 4, the multi-panel display device 3000 includes a plurality of display panels 120 and 130 adjacent to each other in the first and second directions DR1 and DR2, but the number of the display panels need not be limited to two. For example, the multi-panel display device 3000 can include three or more display panels adjacent to one another in the first and second directions DR1 and DR2 or in the third direction DR3.

The display panels 120 and 130 include a first display panel 120 and a second display panel 130. Each of the first and second display panels 120 and 130 can be the display panel 100 described with reference to FIGS. 1 and 2 or the display panel 110 described with reference to FIG. 3.

The first display panel 120 includes display areas DA, a first non-display area NA11, a second non-display area NA12, and an intermediate non-display area NAI1. The second display panel 130 includes display areas DA, a first non-display area NA21, a second non-display area NA22, and an intermediate non-display area NAI2.

The width W3 of the intermediate non-display area NAI1 is substantially equal to or less than a sum of the width W2 of the second non-display area NA12 and the width W4 of the first non-display area NA21.

The width W6 of the intermediate non-display area NA12 is substantially equal to or less than the sum of the width W2 and the width W4.

In some embodiments, when the second non-display area NAI2 and the first non-display area NA21 are not recognizable by the viewer, the intermediate non-display area NAI1 or the intermediate non-display area NAI2 is also not recognizable by the viewer.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display device, comprising:

a display panel, including:

a plurality of display areas spaced apart from one another in a first direction or a second direction opposite to the first direction;

an intermediate non-display area formed between the display areas;

a first non-display area formed at the outermost position in the first direction; and a second non-display area formed at the outermost position in the second direction; and a gate driver formed in each of the first non-display area, the second non-display area, and the intermediate non-display area, wherein the gate driver is configured to supply a gate signal to gate lines formed in each display area, and wherein the gate driver includes a pair of sub-gate drivers adjacent to each other and located in the intermediate non-display area.

2. The display device of claim 1, wherein the number of display areas is greater than or equal to 2, and wherein the number of gate drivers is greater than or equal to the number of display areas and equal to or less than twice the number of display areas.

3. The display device of claim 2, wherein the display areas comprise first and second display areas sequentially arranged in the second direction, and wherein the gate driver comprises:

a first gate driver electrically connected to a plurality of first gate lines formed in the first display area, wherein the first gate driver is configured to supply a first gate signal to the first gate lines; and a second gate driver electrically connected to a plurality of second gate lines formed in the second display area, wherein the second gate driver is configured to supply a second gate signal to the second gate lines.

4. The display device of claim 3, wherein the first gate driver comprises:

a first sub-gate driver formed in the first non-display area and electrically connected to a first end of the first gate lines; and a second sub-gate driver formed in the intermediate non-display area and electrically connected to a second end of the first gate lines, and wherein the second gate driver comprises:

a third sub-gate driver formed in the intermediate non-display area and electrically connected to a first end of the second gate lines; and a fourth sub-gate driver formed in the second non-display area and electrically connected to a second end of the second gate lines, wherein the pair of sub-gate drivers comprise the second and third sub-gate drivers.

5. The display device of claim 4, wherein the first and second sub-gate drivers supply a first gate signal to each of the first gate lines, and wherein the third and fourth sub-gate drivers supply a second gate signal to each of the first gate lines.

6. The display device of claim 4, wherein the first sub-gate driver supplies the first gate signal to the first gate lines, wherein the second sub-gate driver supplies the first gate signal to the first gate lines, wherein the third sub-gate driver supplies the second gate signal to the second gate lines, and wherein the fourth sub-gate driver supplies the second gate signal to the second gate lines.

7. The display device of claim 4, wherein the intermediate non-display area has a width substantially equal to or less than the sum of the width of the first non-display area and the width of the second non-display area.

8. The display device of claim 1, further comprising:

a printed circuit board that is configured to drive the display panel; and a flexible printed circuit board electrically connecting the display panel to the printed circuit board.

9. The display device of claim 1, wherein no display area is interposed between the pair of sub-gate drivers.

10. The display device of claim 1, wherein the plurality of display areas comprise a first display area and a second display area different from each other, wherein one of the pair of sub-gate drivers is configured to drive only the first display area, and wherein the other one of pair of sub-gate drivers is configured to drive only the second display area.

11. The display device of claim 1, wherein the pair of sub-gate drivers are separated from each other.

12. A display device, comprising:

a display panel, including:

a plurality of display areas spaced apart from one another in a first direction or a second direction opposite to the first direction; and a plurality of non-display areas, wherein at least one intermediate non-display area is formed between the display areas, and wherein at least one non-display area is formed in the outermost position in each of the first and second directions; and a gate driver formed in each non-display area, wherein the gate driver is configured to supply a gate signal to gate lines formed in each of the display areas, and wherein the gate driver includes a pair of sub-gate drivers adjacent to each other and located in the intermediate non-display area.

13. The display device of claim 12, wherein the display areas comprise first and second display areas sequentially arranged in the second direction, and wherein the gate driver further comprises:

a first gate driver electrically connected to a plurality of first gate lines formed in the first display area, wherein the first gate driver is configured to supply a first gate signal to the first gate lines; and a second gate driver electrically connected to a plurality of second gate lines formed in the second display area, wherein the second gate driver is configured to supply a second gate signal to the second gate lines.

* * * * *